United States Patent [19]

Mori

[11] Patent Number: 4,586,451

[45] Date of Patent: May 6, 1986

[54] SURFBOARD PROTECTOR

[75] Inventor: Kozo Mori, Tokyo, Japan

[73] Assignee: International Harvest Co., Ltd., Tokyo, Japan

[21] Appl. No.: 629,501

[22] Filed: Jul. 10, 1984

[30] Foreign Application Priority Data

Jul. 13, 1983 [JP] Japan ..... 58-107634[U]

[51] Int. Cl.[4] ..... B63B 59/02

[52] U.S. Cl. ..... 114/219; 441/74; 114/343

[58] Field of Search ..... 114/39.2, 219, 343, 114/364; 441/74; 206/586, 315.1, 592; 150/52 R

[56] References Cited

U.S. PATENT DOCUMENTS

| | | | |
|---|---|---|---|
| 2,389,729 | 11/1945 | Howland | 441/74 |
| 3,055,022 | 9/1962 | Vallquist | 114/219 |
| 3,109,405 | 11/1963 | Nusinoff | 114/219 |
| 3,335,932 | 8/1967 | Brown | 206/586 |
| 3,374,495 | 3/1968 | Joyce | 441/74 |
| 3,809,311 | 5/1974 | Fohrman et al. | 206/586 |
| 3,879,782 | 4/1975 | Oliver | 441/74 |
| 4,483,380 | 11/1984 | Beran | 206/315.1 |

*Primary Examiner*—Galen L. Barefoot
*Assistant Examiner*—Edwin L. Swinehart
*Attorney, Agent, or Firm*—Wenderoth, Lind & Ponack

[57] ABSTRACT

Partial covers, made of flexible material such as rubber, are respectively attached to the nose, rails and tail of a surfboard so that the partial covers protect respectively the nose, rails and tail of the surfboard from damage. The partial covers for the rails are forced on manually and nonadhesively in the direction of an opening thereof. The partial covers for the nose and the tail may be forced on also manually and nonadhesively in the direction of openings therein. However, with or without such openings, the partial covers for the nose and the tail may each have a belt so that each belt fastens the partial covers to the nose and the tail respectively.

1 Claim, 12 Drawing Figures

SURFBOARD PROTECTOR

BACKGROUND OF THE INVENTION

1. Field of the Invention

The present invention relates generally to a surfboard protector which is a partial cover protecting a surfboard from damage and particularly to a partial cover or partial covers protecting respectively the nose, rails or tail along the perimeter of a surfboard from damage.

2. Description of the Prior Art

In a conventional surfboard, no cover is employed when it is in use for surfing on a wave. Therefore, the nose, rails and tail can easily get damaged when they collide with a rock or sand. The nose and tail may also hurt a surfer or other people when the surfer has been swallowed up by a big wave. Moreover, the nose and tail may also bump people when a surfboard is brought into a public place. The rails of a surfboard can also get damaged when the surfboard is fastened with a rope onto a carrier on the roof of a car. The upper face of a surfboard is generally waxed and the bottom face of the surfboard should not be waxed. Therefore, when surfboards are put one on another, the wax on the upper face of a surfboard is stuck on the bottom face of another surfboard. Surfboards with some type of tails such as a pintail can easily fall off when the surfboards are stood on their tails.

BRIEF SUMMARY OF THE INVENTION

The present invention relates to partial covers made of flexible material, such as rubber, being respectively attached to the nose, rails or tail of a surfboard so that the partial covers protect respectively the nose, rails or tail of the surfboard from damage.

The partial covers for the rails are forced on the rails manually and nonadhesively in the direction of openings provided in the covers themselves. The partial cover for the nose or the tail may be forced on the tail manually and nonadhesively in the direction of the opening provided in the cover itself. However, with or without such openings, the partial covers for the nose and the tail may have belts so that the belts fasten the partial covers to the nose or the tail respectively.

It is an object of the present invention to provide partial covers for protecting the nose, rails and/or tail of a surfboard from damage.

It is another object of the present invention to provide partial covers for protecting the nose, rails and/or tail of a surfboard from damage when it is in use at sea.

It is a further object of the present invention to provide partial covers for protecting people from injury by the nose or tail of a surfboard.

Another object of the present invention is to provide partial covers for protecting people from injury when the surfboard is in use at sea.

Furthermore, it is another object of the present invention to provide partial covers for protecting the nose, rails and/or tail of a surfboard when it is carried.

Still further, it is another object of the present invention to provide partial covers for preventing the upper face of one surfboard from sticking wax onto the bottom face of another surfboard when they are put one on another.

The various features which characterize the present invention are pointed out with particularity in the claims annexed to and forming a part of this specification. For a better understanding of the invention, its operating advantage, and specific objects attained by its use, reference should be had to the accompanying drawings and descriptive matter in which there is illustrated and described a preferred embodiment of the invention. It should be understood that any change within the scope of the claims may be resorted to without departing from the spirit of the invention or sacrificing any of the advantages thereof.

BRIEF DESCRIPTION OF THE DRAWINGS

FIG. 3 shows an embodiment of a protector for the nose of a surfboard.

FIG. 4 shows an embodiment of a protector for the rails of the surfboard.

FIG. 5 shows an embodiment of a protector for the tail of the surfboard.

DESCRIPTION OF THE PREFERRED EMBODIMENT

A preferred embodiment of the present invention will now be described by way of example, by reference to the accompanying drawings.

The present invention comprises a surfboard protector, which is a partial cover or has partial covers for protecting the nose, rails and/or tail of surfboard from damage. The covers, being made of flexible material such as rubber, are respectively form-fitted to the shape of the nose, rails or tail of the surfboard. The covers are forced on manually and nonadhesively in the direction of the openings in the partial covers which respectively fit the nose, rails or tail of the surfboard.

Embodiments of the present invention will be described with reference to the drawings thereof as follows.

Figure 1:
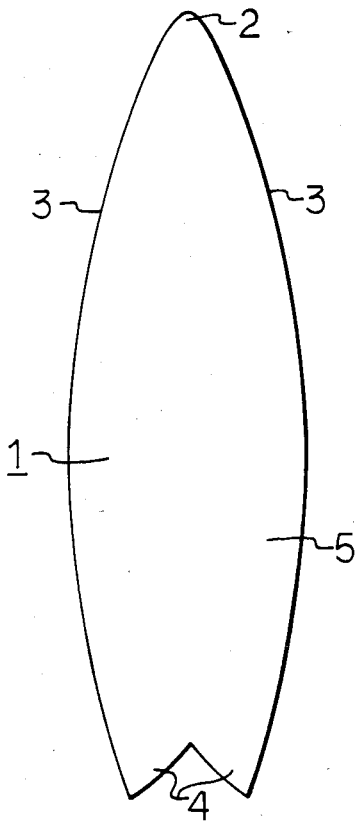
FIG. 1 is a top plan view of a surfboard.
Figure 2:
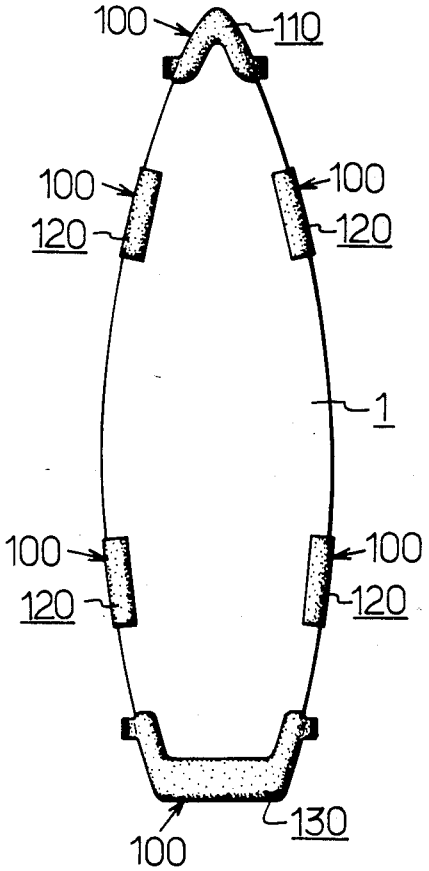
FIG. 2 is a top plan view of a surfboard with protectors of one embodiment of the present invention attached thereto.

FIG. 1 shows a surfboard 1, which has a nose 2, rails 3, tail 4 and deck 5. As shown in FIG. 2, partial covers or protectors 100 are attached to the surfboard 1. A nose cover 110 is used either as a part of a set of surfboard protectors 100 or as an independent surfboard protector by itself.

Figure 3C:
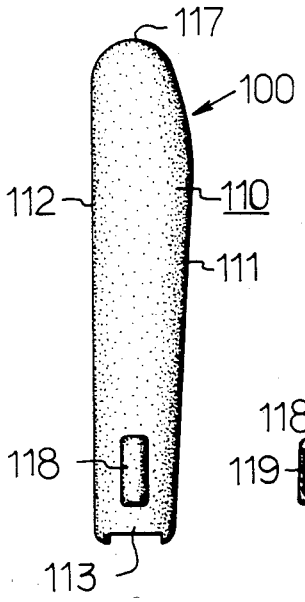
FIG. 3*c* is a left side view thereof.
Figure 3A:
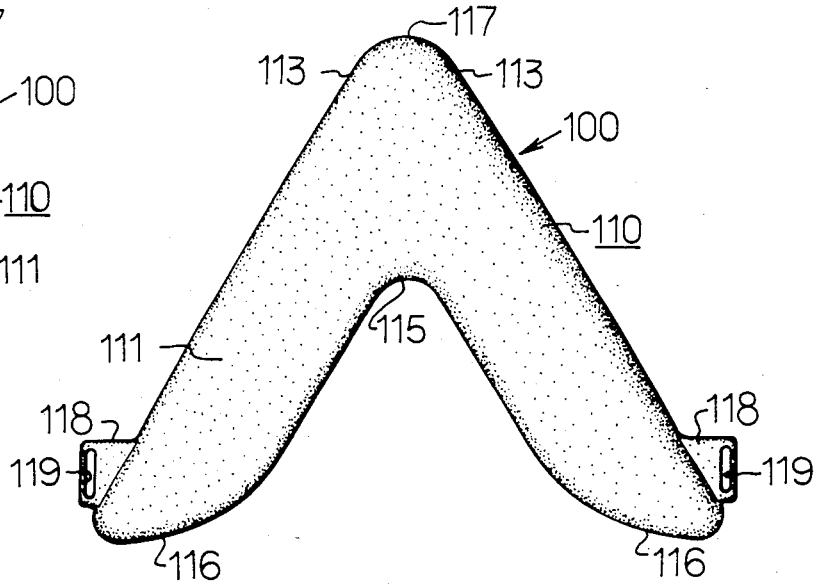
FIG. 3*a* is a top plan view thereof.
Figure 3B:
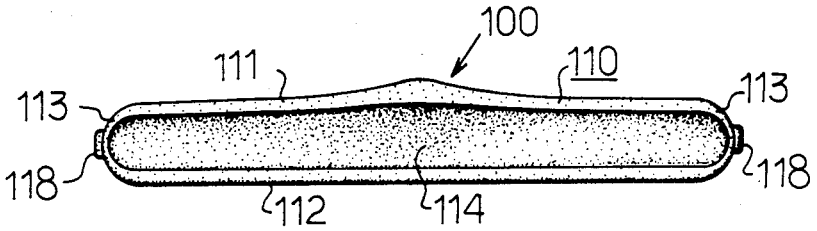
FIG. 3*b* is a rear view showing the interior thereof.

The nose cover 110 for the surfboard is shown in detail in FIGS. 3*a*, 3*b* and 3*c*. The nose cover 110 comprises an upper part 111, bottom part 112, side part 113 and openings 114. A concavity 115 is illustrated in the top plan view of FIG. 3*a*. The concavity 115 forms wings 116 which are easy to open widely so that the nose 2 of a surfboard 1 can be easily inserted into openings 114 of the nose cover 110 illustrated in the rear view of FIG. 3*b*. The openings 114 are shaped such that the nose cover 110, fits the shape of the nose 2. The top part 117 of the nose cover 110 protects the top part of the nose 2 so that the top part 117 will protect people from injury by the top part of the nose 2 especially when a surfboard 1 is in use in the sea.

The nose cover 110 may have a pair of belt holders 118 integrally fixed toward the ends of the wings 116. The belt holders 118 have belt holes 119 respectively so that a belt can be held through the belt holes 119 with the belt holders 118 connected to the wings 116. The belt (not shown) will fasten the wings 116 to the nose 2 tightly when the belt is fastened on the wings 116 of the nose 2.

FIG. 4 shows an embodiment of a rail cover 120, which can be used as a pair or pairs as illustrated in FIG. 2. The rail cover 120 can be used either as a part of a set of the surfboard protectors 100 or as an independent surfboard protector 110 by itself, too.

Figure 4A:
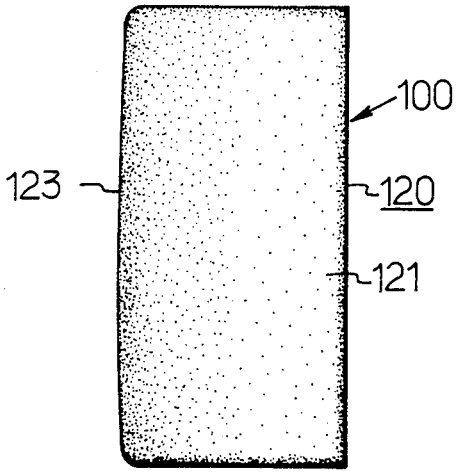
FIG. 4*a* is a top plan view thereof.
Figure 4B:
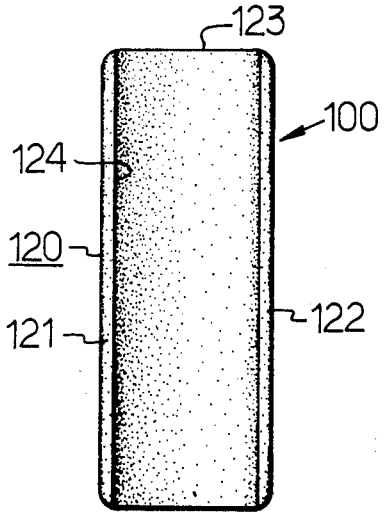
FIG. 4*b* is a side view thereof.
Figure 4C:
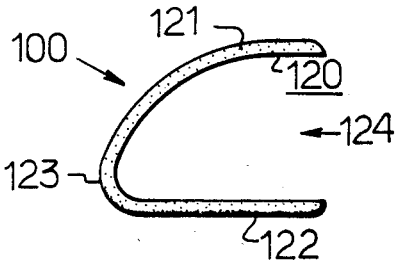
FIG. 4*c* is a rear view thereof.
Figure 4D:
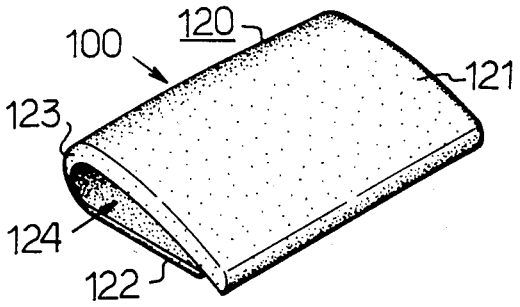
FIG. 4*d* is a perspective view thereof.

The rail cover 120 comprises the upper part 121, bottom part 122, side part 123, and opening 124. The upper part 121 and the bottom part 122 are forced manually and nonadhesively in the direction of the opening 124. Since the rail cover 120 is itself made of rubber, the upper part 121 and the bottom part 122 close the opening 124 as illustrated in FIG. 4*d* when the rail cover 120 does not cover the rail 3. Therefore, the upper part 121 and the bottom part 122 are opened when the rail cover 120 protects the rail 3. Consequently, the upper part 121 and the bottom part 122 will tightly pinch the rail 3 when the rail 3 has been inserted in the opening 124. Thus, the rail cover 120 will not come off the rail 3 even if the surfboard 1 is used in a rough sea.

Figure 5C:
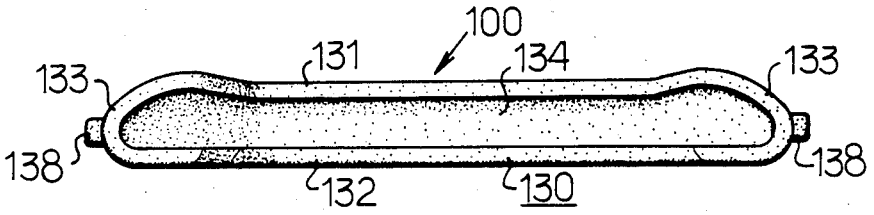
FIG. 5*c* is a rear view showing the interior thereof.
Figure 5B:
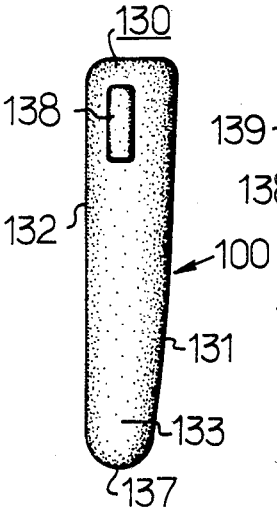
FIG. 5*b* is a left side view thereof.
Figure 5A:
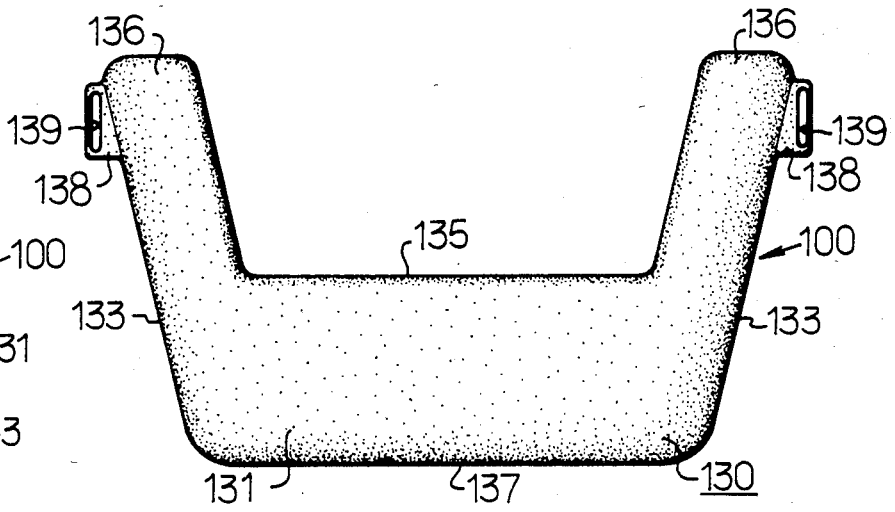
FIG. 5*a* is a top plan view thereof.

FIG. 5 illustrates an embodiment of a tail cover 130 which can be used either as a part of a set of the surfboard protectors 100 or as an independent surfboard protector, too.

The partial cover or tail protector 130 comprises upper part 131, bottom part 132, side part 133 and opening 134. A concavity 135 forms wings 136 and makes the wings 136 easy to open so that the tail 4 can be easily inserted into the opening 134 of the tail cover 130 illustrated in the rear view of FIG. 5*c*. The opening 134 is shaped such that it covers the tail 4. An end 137 of the tail cover 130 is flat. Therefore, the tail cover 130 may be attached to a standing surfboard 1 when the surfboard 1 is leaned against a wall.

Since there are many kinds of tails such as round, square, swallow, pintail, and so on, the tail cover 130 may be shaped so that each tail cover exclusively fits to each different kind of tail respectively. However, the tail cover 130 may be shaped so that one tail cover protects all kinds of tails, so that manufacturing costs can be reduced.

The tail cover 130 may have a pair of belt holders 138 arranged toward the end of the wings 136. The belt holders 138 have belt holes 139 respectively so that a belt (not shown) can be threaded through the belt holes 139 in the belt holders 138 connected to the wings 136. The belt will fasten the wings 136 to the tail 4 tightly when the belt is fastened on the wings 136 of the tail cover 130.

I claim:

1. A protector for preventing damage to a surfboard, comprising:

a plurality of separate partial covers being spaced along a perimeter of the surfboard and each of the separate partial covers being provided with an opening therein;

said plurality of separate partial covers being made of flexible material and having each of the openings forcibly form-fitted manually and nonadhesively over a nose, and a tail on the perimeter of the surfboard;

each of said separate partial covers forcibly form-fitted to the nose and the tail having a concavity which forms wing means for easily opening widely the separate partial covers for the nose and the tail so that said nose and said tail may be easily inserted into each of the openings therefor; and belt holders being integrally fixed near ends of the wing means for the nose and the tail and having belt holes therein.

* * * * *